US005775045A

United States Patent [19]

Hill

[11] Patent Number: 5,775,045

[45] Date of Patent: Jul. 7, 1998

[54] DOOR FRAME GUARD

[76] Inventor: Donald L. Hill, 1860 Rainbow La., Powder Springs, Ga. 30073

[21] Appl. No.: 785,758

[22] Filed: Jan. 18, 1997

[51] Int. Cl.[6] ..... E06B 1/04

[52] U.S. Cl. ..... 52/211; 52/DIG. 4; 52/DIG. 12; 52/717.01; 52/717.03; 49/57

[58] Field of Search ..... 52/211, 717.01, 52/717.03–717.05, 631, 730.3, 730.6, 515, 514, DIG. 4, DIG. 12, 741.3; 49/50, 57, 262

[56] References Cited

U.S. PATENT DOCUMENTS

| | | | |
|---|---|---|---|
| 3,102,314 | 9/1963 | Alderfer | 52/DIG. 4 X |
| 3,119,156 | 1/1964 | Selter | 52/631 |
| 3,130,455 | 4/1964 | Borlenghi | 52/211 X |
| 3,341,996 | 9/1967 | Jones et al. | 52/DIG. 4 X |
| 3,543,465 | 12/1970 | Jackson | 52/717.04 X |
| 4,360,549 | 11/1982 | Ozawa et al. | 49/462 X |
| 4,768,320 | 9/1988 | Weller | 52/211 |
| 4,877,673 | 10/1989 | Eckel et al. | 52/717.03 X |
| 5,203,130 | 4/1993 | Freelove | 52/211 |

FOREIGN PATENT DOCUMENTS

| | | | |
|---|---|---|---|
| 000406626 A | 1/1991 | European Pat. Off. | 52/717.01 |

*Primary Examiner*—Robert Canfield

*Attorney, Agent, or Firm*—Troutman Sanders LLP; R. Stevan Coursey, Esq.

[57] ABSTRACT

A door frame guard comprising, in accordance with an apparatus of the preferred embodiment of the present invention, a plurality of interface members and a linking member flexibly connected to the plurality of interface members. Each interface member of the plurality of interface members is sized interface appropriately with a respective surface of a door frame without extending into door frame corners or about door frame edges. Adjacent interface members define gaps which extend between a top edge and a bottom edge of the door frame guard in a direction substantially parallel to side edges of the door frame guard. The gaps and linking member enable adjacent interface members to rotate relative to one another and relative to the other interface members. According to a method of the preferred embodiment of the present invention, the plurality of interface members of the door frame guard reside adjacent to surfaces of an upright side of a door frame and interact magnetically with the surfaces to removably secure the door frame guard to the door frame. When so positioned the gaps of the door frame guard reside adjacent to and align with corners and edges of the door frame and the linking member spans the door frame from front to back within the door frame opening, thereby enabling the front surface of the linking member to protect the paint on the corners and edges of the door frame from bumps, bangs, and scrapes which may tend to chip or wear away the paint.

10 Claims, 5 Drawing Sheets

DOOR FRAME GUARD

FIELD OF THE INVENTION

This invention relates generally to the field of building maintenance products, and in its most preferred embodiment, to devices which protect the paint on door frames.

BACKGROUND OF THE INVENTION

Painters and building maintenance workers are often called upon to repaint door frames in many commercial establishments because the paint on the door frames has been chipped off or has been worn away. Most frequently, the repainted door frames are metal door frames which are located in commercial establishments, such as office buildings, where tenants and occupants expect to spend time in a pleasant environment free of door frames having corners and edges where paint is no longer present and where the unsightly bare metal of the frames is exposed for all to see. In order to placate tenants and occupants who complain, or who will soon complain, about seeing the bare metal of their door frames, property managers must have the offending door frames either "touched-up" or completely repainted at what can be a substantial cost and inconvenience for a building having hundreds or thousands of doors.

The problem of paint chipping or wearing on door frames has, as its root causes, the fact that door frame edges and corners are Extremely vulnerable as they are exposed to all kinds of bumps, bangs, and scrapes. The bumps, bangs, and scrapes come from a variety of sources and come at different times, luring the life of a door frame and can instigate, or certainly accelerate, the loss of paint from the corners and/or edges of a door frame. For instance, during construction and/or renovation of a building, the office walls are built and the door frames installed (and painted) at an early stage of the construction or renovation process. Thereafter, the painted door frames are exposed to bumps, bangs, and scrapes from various workers (and their tools, equipment, and materials) who perform, for example, such tasks as refinishing floors, installing carpet and moldings, running electrical and communications wiring, installing ceiling and lighting systems, etc. Once a building or office space is constructed, the bumps, bangs, and scrapes often come from cleaning crews who bang vacuum cleaners, trash cans, and other equipment or articles into door frames and who allow vacuum cleaner cords to stretch around door frames during vacuuming, thereby causing the cords to contact the corners and/or edges of the door frames with a rubbing action, resulting in wearing away of the paint on the corners and/or edges of the door frames. The bumps, bangs, and scrapes also often come from movers who hit door frames with furniture, filing cabinets, computers, printers, copiers, etc. while moving a tenant or occupant into or out of a building. Additionally, bumps, bangs, and scrapes can come from ill-fitting doors which scrape their respective door frames, tenants and occupants who bump into door frames, and numerous other causes.

There is, therefore, a need in the industry for a device that protects the paint on door frames which addresses these and other unrelated, and unrelated, problems.

SUMMARY OF THE INVENTION

Briefly described, the present invention includes a door frame guard which protects paint on a metal door frame from being chipped and/or worn away by external forces. More particularly, the present invention includes a removable door frame guard having a plurality of interface members which interact with surfaces of a metal door frame and a linking member which extends between the plurality of interface members and spans the contour of the door frame from front to back in order to protect the paint on the door frame.

In the preferred embodiment of the present invention, a door frame guard comprises a plurality of interface members which connect to a flexible linking member. The plurality of interface members extend between top and bottom edges of the door frame guard with adjacent interface members defining a gap therebetween. Each interface member is sized to allow the interface member to appropriately rest adjacent to a respective surface of the door frame without extending into a corner or across an edge of the door frame. Each gap, of the plurality of gaps so defined, extends between the top and bottom edges of the door frame guard and parallel to side edges of the door frame guard, thereby enabling rotation of an interface member relative to an adjacent interface member by providing clearance between the interface members.

According to a method of the preferred embodiment of the present invention, the interface members reside adjacent to the various surfaces of a metal door frame at positions defined between the corners and/or edges of the door frame. The gaps align with and reside adjacent to the corners and/or edges of the door frame to allow the rotation between interface members necessary to appropriately position the interface members. Because the interface members are, preferably, manufactured from magnetic material, the interface members removably secure themselves to the surfaces of the metal door frame and support the linking member. The linking member extends adjacent to the interface members opposite the door frame surfaces and, by virtue of its flexible nature, extends adjacent to corners and edges of the door frame to conform the linking member and, hence, the door frame guard to the contour of the door frame. Because the linking member spans the interface members and the gaps therebetween (and, hence, the corners and edges of the door frame) and because the inking member is, preferably, manufactured from a durable material, the linking member protects the paint on the surfaces, corners, and edges of the door frame by shielding it from damage causing elements.

According to an alternate embodiment of the present invention, a door frame guard, substantially similar to that of the preferred embodiment, comprises a plurality of interface members connected to a flexible linking member. Unlike the interface members and gaps of the preferred embodiment, each interface member has a size equal to the other interface members and each gap has a size equal to the other gaps. Additionally, the numbers of interface members and gaps are greater than the numbers of their counterparts in the preferred embodiment. The equal sizes and increased numbers of interface members and gaps enable the door frame guard of the alternate embodiment to be removably secured to a wider variety of different door frames (i.e., having different numbers, sizes, and configurations of surfaces, corners, and edges) than the door frame guard of the preferred embodiment.

Accordingly, an object of the present invention is to reduce the loss of paint from door frames.

Another object of the present invention is to protect various surfaces, corners, and edges of a door frame.

Still another object of the present invention is to protect various surfaces, corners, and edges of a door frame from all types of bumps, bangs, and scrapes.

Still another object of the present invention is to protect various surfaces, corners, and edges of a door frame with a device which is usable during construction of the building in which the door frame resides.

Still another object of the present invention is to protect various surfaces, corners, and edges of a door frame with a device which is usable after construction of the building in which the door frame resides.

Still another object of the present invention is to inexpensively protect various surfaces, corners, and edges of a door frame.

Still another object of the present invention is to protect various surfaces, corners, and edges of a door frame with a device which is simple to use.

Still another object of the present invention is to protect various surfaces, corners, and edges of a door frame with a device which mounts directly to the door frame.

Still another object of the present invention is to protect various surfaces, corners, and edges of a door frame with a single element device.

Still another object of the present invention is to protect various surfaces, corners, and edges of a door frame with a single element device which mounts directly to the door frame without the use of fastening elements.

Still another object of the present invention is to protect various surfaces, corners, and edges of a door frame with a device which removably mounts to the door frame.

Still another object of the present invention is to protect various surfaces, corners, and edges of a door frame with a device which does not contact a wall near the door frame.

Still another object of the present invention is to protect various surfaces, corners, and edges of a door frame with a device which does not attach, directly or indirectly, to a wall near the door frame.

Still another object of the present invention is to universally protect various surfaces, corners, and edges of different sized door frames.

Other objects, features, and advantage; of the present invention will become apparent upon reading and understanding the present specification when taken in conjunction with the appended drawings.

BRIEF DESCRIPTION OF THE DRAWINGS

FIG. 1 1 is an isolated, top, plan view of the door frame guard of FIG. 10.

DETAILED DESCRIPTION OF THE PREFERRED EMBODIMENT

Figure 1:
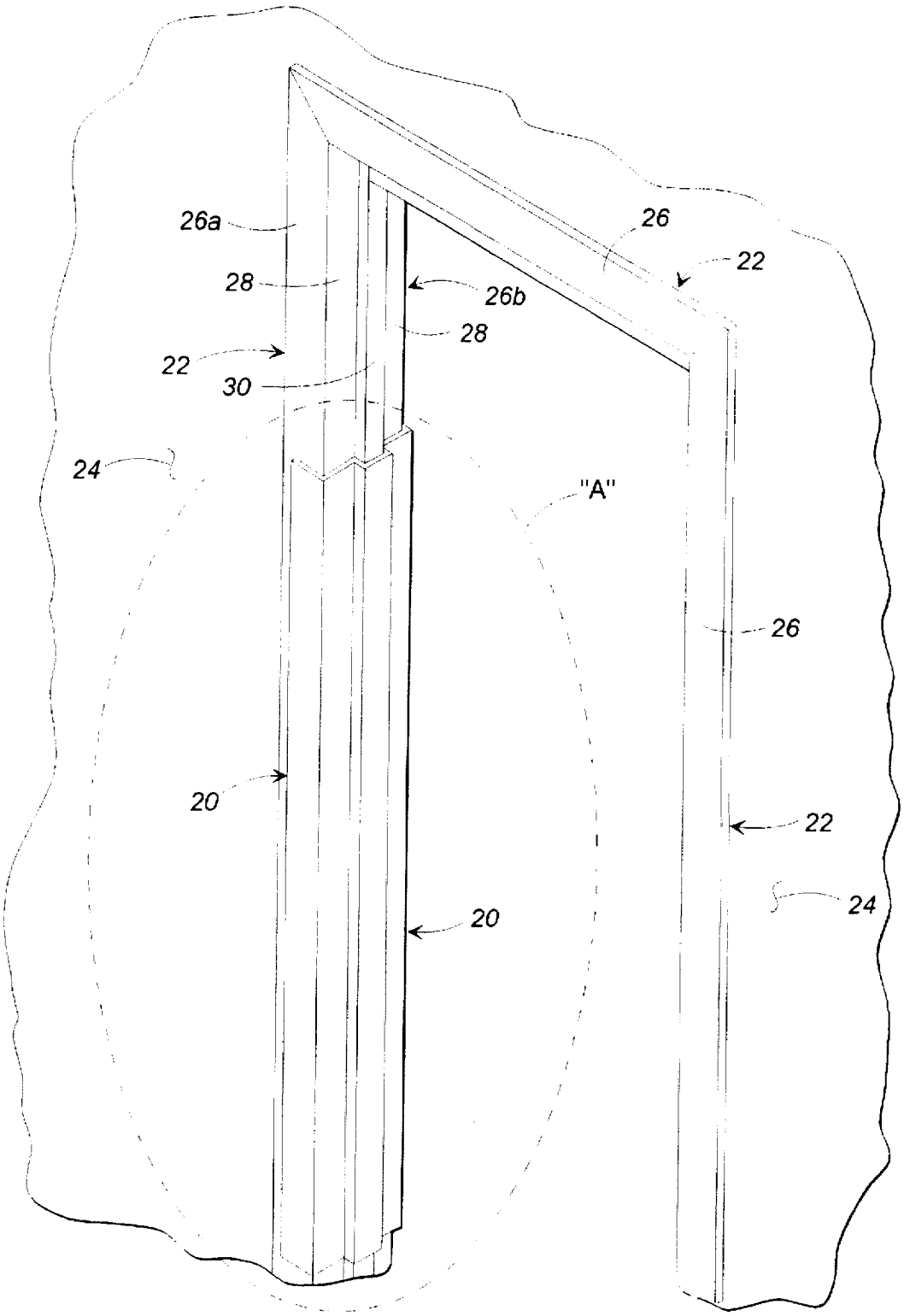
FIG. 1 is a front, perspective view of a door frame guard, in accordance with the preferred embodiment of the present invention which is mounted to a door frame.
Figure 2:
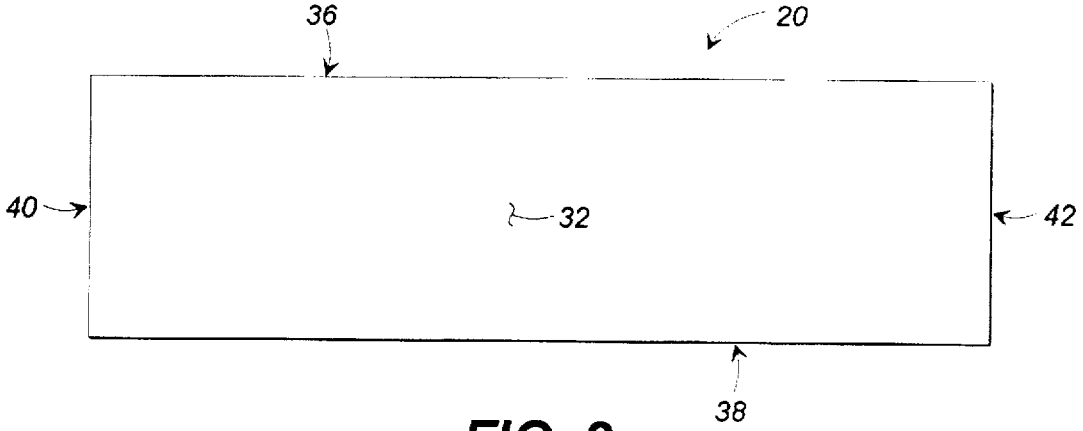
FIG. 2 is an isolated, front, elevational view of a door frame guard in accordance with the preferred embodiment of the present: invention.
Figure 3:
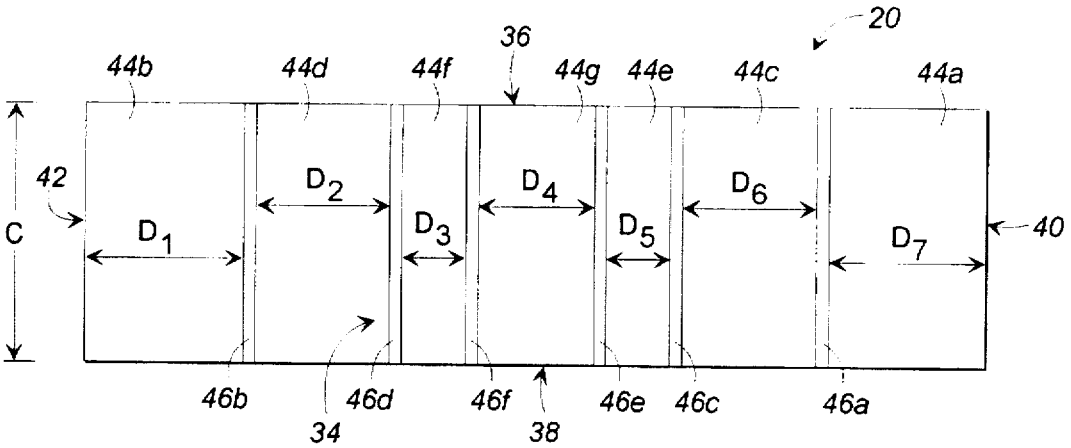
FIG. 3 is an isolated, back, elevational view of the door frame guard of FIG. 2.
Figure 4:
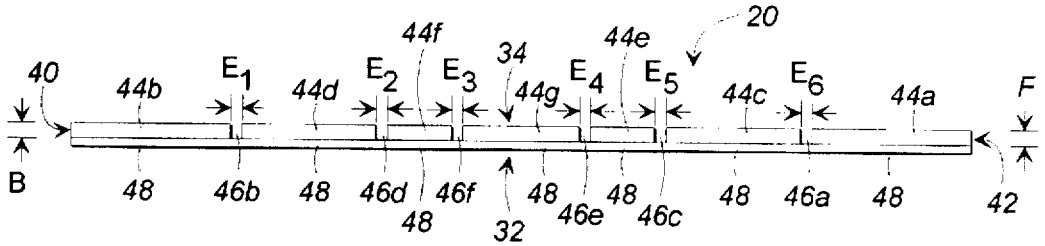
FIG. 4 is an isolated, top, plan view of the door frame guard of FIG. 2.
Figure 5:
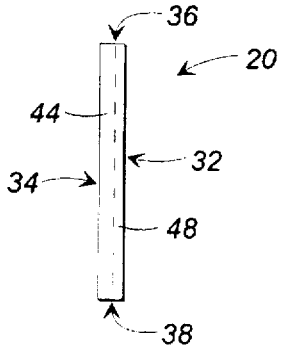
FIG. 5 is an isolated, left side, elevational view of the door frame guard of FIG. 2.

Referring now to the drawings, in which like numerals represent like components throughout the several views, FIG. 1 displays a door frame guard 20, in accordance with the preferred embodiment of the present invention, mounted adjacent to the left upright side of the door frame 22 in wall 24. The door frame guard 20, when in use as illustrated in FIG. 1, bends and folds substantially about he contour of door frame 22 which is defined by trim moldings 26, jamb 28, and stop 30. Preferably, the door frame guard 20 is manufactured from magnetic vinyl material. Note that while the door frame guard 20 is shown adjacent to the left upright side of door frame 22, the door frame guard 20 is mountable to either upright side of a door frame.

The door frame guard 20, as shown in FIGS. 2–5, is orientable in a substantially planar configuration when not in use and has a front surface 32, a back surface 34, a top edge 36, a bottom edge 38, a left side edge 40 and a right side edge 42. Because the front surface 32 of the door frame guard 20 is exposed to potential damage causing elements for the door frame 22 such as, for ex ample, persons, equipment, cords, etc. when in use, the front surface 32 is, preferably, smooth to enable damage causing elements to better negotiate through the opening defined by the door frame 22, thereby reducing the opportunity for damage to the door frame 22. The front surface 32 and back surface 34 define a thickness, "B", of the door frame guard 20 (see FIG. 4) which, preferably, has a measure in the range between 45 and 90 mils. The top and bottom edges 36, 38 define a length, "C", of the door frame guard 20 (see FIG. 3) which, when the door frame guard 20 is in use, extends in a direction defined by the ends of an upright side of a door frame 22. The measure of length, "C", is defined by the portion of the height of door frame 22 which is to be protected by the door frame guard 20.

In accordance with the preferred embodiment of the present invention, the back surface 34 of the door frame guard 20 comprises a plurality of interface members 44 and a plurality of gaps 46 (also referred to herein as "grooves as") with adjacent interface members 44 defining a gap 46 of the plurality of gaps 46 therebetween. Each interface member 44 extends between the top edge 36 and the bottom edge 38 and has a width, "D" extending in a direction defined between side edges 40,42 (see FIG. 3). Widths, "D", of specific interface members 44 are sized to enable the interface members 44 to interact appropriately with respective planar surfaces 50, 52, 54, 56 of the door frame 22 as described below. Each gap 46 of the plurality of gaps 46 extends between the top edge 36 and he bottom edge 38, substantially parallel to the left side and right side edges 40, 42 of the door frame guard 20, and defines a width, "E", (see FIG. 4) having a measure which allows the gaps 46 to align with respective edges 58, 62 and respective corners 60 of the door frame 22, as described below, when the door frame guard 20 is in use. Additionally, each gap 46 of the plurality of gaps 46 also extends in a direction defined between the front and back surfaces 32, 34 for a distance (or depth), "F", to a linking member, 8 which interconnects the interface members 44 and defines the front surface 32 of the door frame guard 20 (see FIG. 4). Preferably, the interface members 44 comprise segments of the magnetic layer of a magnetic vinyl material, while the linking member 48 comprises a flexible vinyl layer of the magnetic vinyl material.

Figure 6:
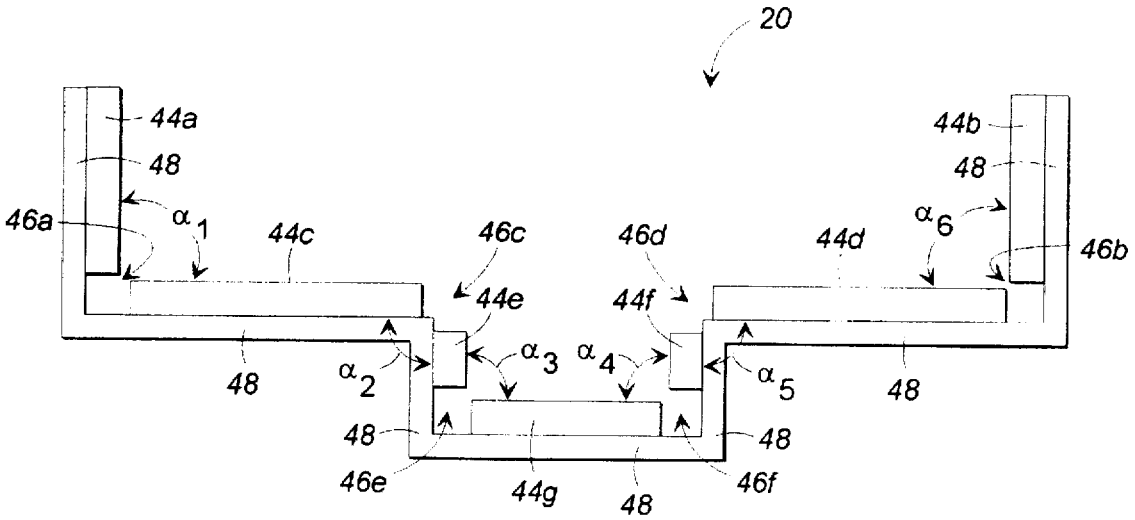
FIG. 6 is an isolated, top, plan view of the door frame guard of FIG. 1.

FIG. 6 displays the door frame guard 20 isolated from the door frame 22, yet configured as if the door frame guard 20 was in position adjacent to the door frame 22 (see FIG. 1).

Note that, in this configuration, adjacent interface members 44 are rotated relative to one another to define angles, α, which, according to the preferred embodiment, measure ninety (90) degrees. The formation of angles, α, is enabled by the flexible nature of the material which defines the linking member 48 and by the gaps 46 defined between adjacent interface members 44.

Figure 7:
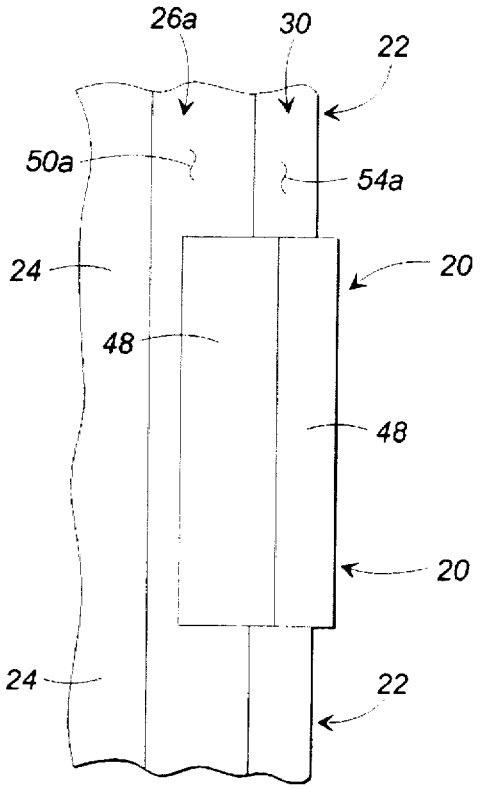
FIG. 7 is a front, elevational view of region "A" of FIG. 1.
Figure 8:
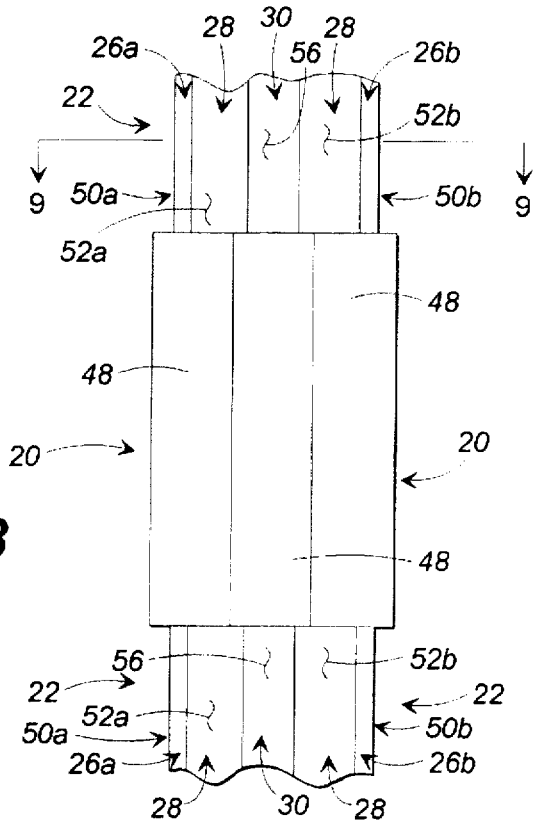
FIG. 8 is a right side, elevational view of region "A" of FIG. 1.
Figure 9:
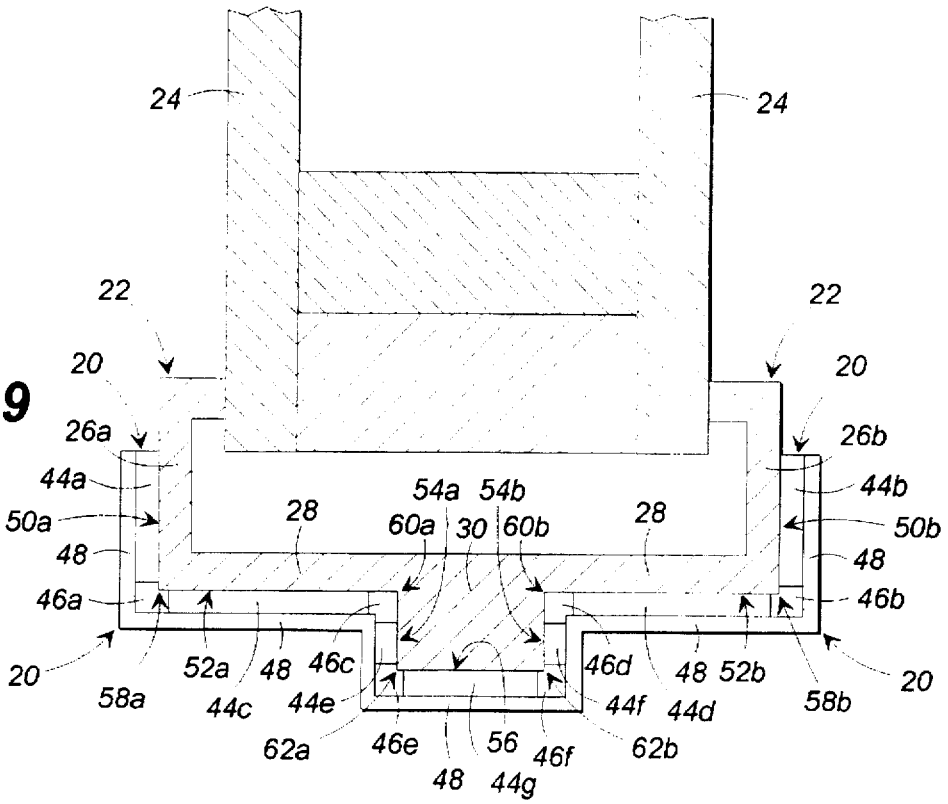
FIG. 9 is a top, plan, sectional view taken along lines 9—9 of FIG. 8.

In accordance with a preferred method of the present invention, the door frame guard 20, as shown in FIGS. 7–9, is positions adjacent to the metal door frame 22 within the opening of the frame 22 at a location which is to be protected, as determined by a user, by the door frame guard 20. To position the door frame guard 20, the user rotates and orients adjacent interface members 44 to ring interface members 44*a,b* into contact with planar surfaces 50*a,b* of trim moldings 26*a,b*, interface members 44*c,d* into contact with planar surfaces 52*a,b* of jamb 28, interface members 44*e,f* into contact with planar surfaces 54*a,b* of stop 30, and interface member 44*g* into contact with planar surface 56 of stop 30. The widths and orientation of the interface members 44, in conjunction with the widths of the gaps 46, causes gaps 46*a,b* to align with door frame edges 58*a,b*, gaps 46*c,d* to align with door frame corners 60*a,b*, and gaps 46*e,f* to align with door frame edges 62*a,b*. Once in position, the magnetic property of interface members 44 allows the door frame guard 20 to adhere to the trim moldings 26, jamb 28, and stop 30 of the metal door frame 22, thereby removably holding the door frame guard 20 in place. By covering a desired portion of trim moldings 26, jamb 28, and stop 30 and a desired portion of edges 58, corners 60, edges 62 with a material which is considerably impervious to bumps, bangs, and scrapes, the door frame guard 20 significantly protects the covered paint on surfaces 50, 52, 54, 56, edges 58, 62, and corners 60 from chipping and/or rubbing off of the door frame 22.

Figure 10:
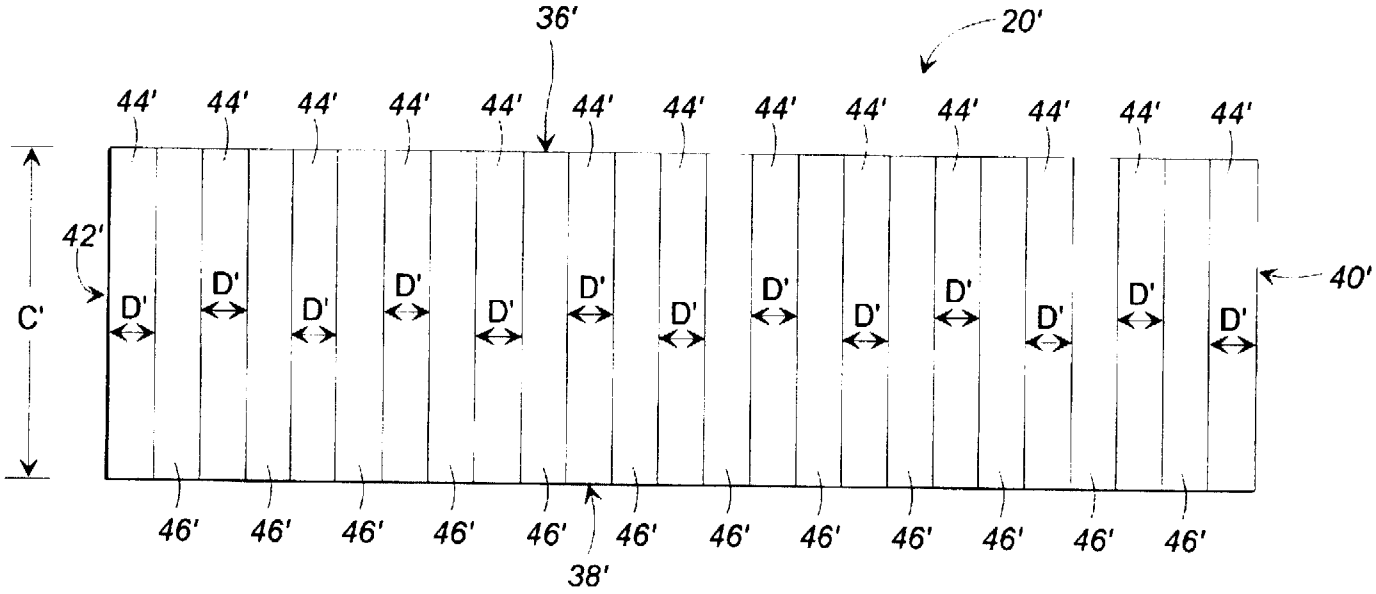
FIG. 10 is an isolated, back, elevational view of a door frame guard in accordance with an alternate embodiment of the present invention.
Figure 11:
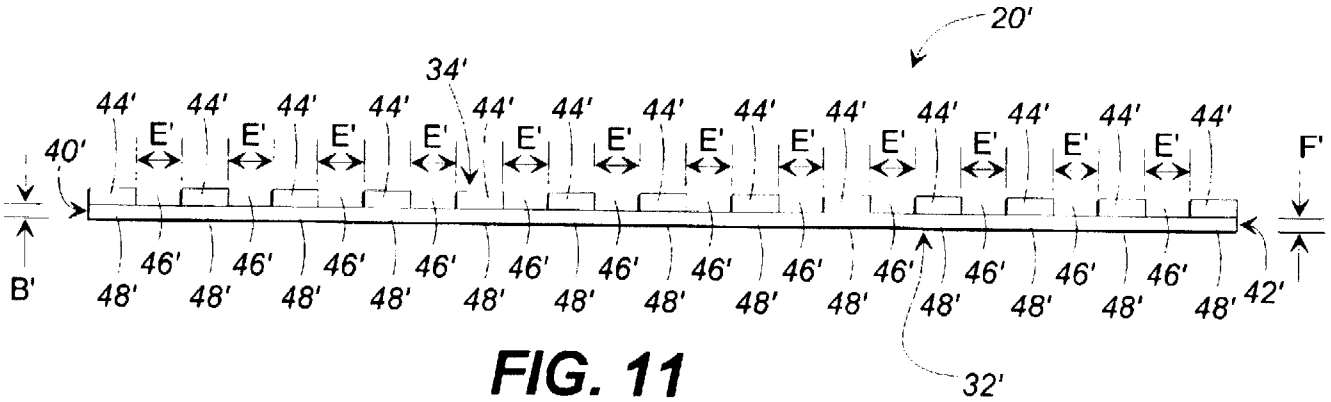

FIGS. 10 and 11 display a door frame guard 20', in accordance with an alternate embodiment of the present invention, which is substantially similar to the door frame guard 20 of the preferred embodiment. The back surface 34' of the door frame guard 20' comprises a plurality of interface members 44' and a plurality of gaps 46' with adjacent interface members 44' defining a gap 46' of the plurality of gaps 46' therebetween. Each interface member 44' extends between the top edge 36' and the bottom edge 38' and has a width, "D'" (see FIG. 10) extending in a direction defined between side edges 40', 42'. Widths, "D'", of interface members 44' are equal in size and, preferably, measure ¼ inch. Each gap 46' of the plurality of gaps 46' extends between the top edge 36' and the bottom edge 38', substantially parallel to the left side and right side edges 40', 42' of the door frame guard 20', and defines a width, "E'" (see, FIG. 11). Widths, "E'", of gaps 46' are equal in measure and, preferably, measure ¼ inch. The equal measures of widths, "D'", and the equal measures of widths, "E'", enable the interface members 44' and gaps 46' to interface with a variety of door frames 22, each having a different number of surfaces, edges, and corners and having different dimensional characteristics.

It is understood that the scope of the present invention includes door frame guards having a different number of interface members, a different number of gaps, different interface member widths, different gap widths and different gap depths than the door frame guard 20 of the present invention. It is further understood that the scope of the present invention includes door frame guards: having portions which are manufactured from materials different than that of the preferred embodiment.

Whereas this invention has been described in detail with particular reference to its most preferred embodiment, it is understood that variations and modifications can be effected within the spirit and scope of the invention, as described herein before and as defined in the appended claims.

I claim:

1. In combination, a metal door frame comprising a first metal molding having a planar surface, a second metal molding having a planar surface, a metal jamb having first and second planar surfaces, and a metal stop having first, second, and third planar surfaces, said metal door frame having a plurality of edges and a plurality of corners formed at intersections between various planar surfaces if said first metal molding, said second metal molding, said metal jamb, and said metal stop; and, a magnetic door frame guard magnetically secured to said metal door frame, said magnetic door frame guard having a first side adjacent to said metal door frame and a second side facing away from said metal door frame, said first side having a plurality of magnetic planar surfaces and a plurality of grooves wherein one groove of said plurality of grooves resides between adjacent magnetic planar surfaces of said plurality of magnetic planar surfaces, said second side having a continuous damage-resistant surface;

wherein magnetic planar surfaces of said plurality of magnetic planar surfaces of said first side magnetically attract and contact said planar surfaces of said first metal molding, said second metal molding, said metal jamb, and said metal stop;

wherein grooves of said plurality of grooves align opposite said edges of said plurality of edges and said corners of said plurality of corners.

2. The combination of claim 1 wherein said magnetic door frame guard is orientable in a substantially planar configuration when not in use adjacent a metal door frame.

3. The combination of claim 1 wherein said magnetic door frame guard is of one-piece construction.

4. The combination of claim 1 wherein said magnetic door frame guard is manufactured from magnetic vinyl material.

5. The combination of claim 4 wherein said first side of said magnetic door frame guard comprises a magnetic layer of magnetic vinyl material and said second side of said magnetic door frame guard comprises a vinyl layer of magnetic vinyl material.

6. The combination of claim 4 wherein said first side and said second side define a distance therebetween and said distance measures between 45 and 90 mils inclusive.

7. The combination of claim 1 wherein said magnetic door frame guard is bendable in the areas of said grooves of said plurality of grooves.

8. The combination of claim 1 wherein each groove of said plurality of grooves has a width approximately measuring one quarter of an inch.

9. The combination of claim 1 wherein adjacent magnetic planar surfaces of said plurality of magnetic planar surfaces define an angle therebetween approximately measuring ninety (90) degrees.

10. The combination of claim 1 wherein the width of each magnetic planar surface of said plurality of magnetic planar surfaces and the width of each groove of said plurality of grooves have substantially the same measure.

* * * * *